US011383121B1

(12) United States Patent
Olson

(10) Patent No.: US 11,383,121 B1
(45) Date of Patent: Jul. 12, 2022

(54) PULLEY WEIGHT EXERCISE METHOD AND SYSTEM

(71) Applicant: Gregory Scott Olson, Owatonna, MN (US)

(72) Inventor: Gregory Scott Olson, Owatonna, MN (US)

( * ) Notice: Subject to any disclaimer, the term of this patent is extended or adjusted under 35 U.S.C. 154(b) by 0 days.

(21) Appl. No.: 17/574,215

(22) Filed: Jan. 12, 2022

(51) Int. Cl.

| | |
|---|---|
| ***A63B 21/075*** | (2006.01) |
| ***A63B 21/062*** | (2006.01) |
| ***A63B 21/072*** | (2006.01) |
| ***A63B 21/00*** | (2006.01) |

(52) U.S. Cl.
CPC ..... *A63B 21/075* (2013.01); *A63B 21/063* (2015.10); *A63B 21/0726* (2013.01); *A63B 21/0728* (2013.01); *A63B 21/154* (2013.01)

(58) Field of Classification Search
CPC . A63B 21/075; A63B 21/063; A63B 21/0726; A63B 21/0728; A63B 21/154; A63B 21/072–075; A63B 21/151–156; A63B 21/0004; A63B 21/00058; A63B 21/00065; A63B 21/06–0607; A63B 21/062–0632
See application file for complete search history.

(56) References Cited

U.S. PATENT DOCUMENTS

| | | | | |
|---|---|---|---|---|
| 5,769,762 | A * | 6/1998 | Towley, III | A63B 21/0605 482/93 |
| 5,779,604 | A * | 7/1998 | Towley, III | A63B 21/0728 482/107 |
| 8,444,537 | B1 * | 5/2013 | Santoro | A63B 21/00181 482/92 |
| 2013/0267392 | A1 * | 10/2013 | Miranda | A63B 21/28 482/102 |
| 2016/0089559 | A1 * | 3/2016 | Smith | A63B 21/00065 482/5 |

* cited by examiner

*Primary Examiner* — Joshua Lee
*Assistant Examiner* — Catrina A Letterman

(57) ABSTRACT

A pulley weight exercise method includes the placement of a plurality of weights from an adjustable dumbbell on a base. The weights each have a centrally positioned opening vertically extending therethrough to define a receiving space. A user determines a quantity of the weights to be used during an exercise to define a selected number. The selected number of the weights is engaged to a carriage. The carriage is attached to a first end of a cable positioned on a pulley suspended from an upper end of a vertical support. The vertical support is attached to and extends upwardly from the base. Pulling a second end of the cable pulls the carriage and the secured weights upwardly toward the upper end. To perform an exercise, a handgrip is attached to the second end of the cable.

11 Claims, 13 Drawing Sheets

PULLEY WEIGHT EXERCISE METHOD AND SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pulley utilizing exercising device and more particularly pertains to a new pulley utilizing exercising device for allowing multi-use of weight from an adjustable dumbbell.

(2) Description of Related Art Including Information Disclosed Under 37 CFR 1.97 and 1.98

The prior art relates to pulley utilizing exercising devices which utilize weight plates that, while movable along a vertical track, are not removable from a pulley exercising device and therefore are relegated to a single usage with a cable system.

BRIEF SUMMARY OF THE INVENTION

An embodiment of the disclosure meets the needs presented above by generally comprising the placement of a plurality of weights from an adjustable dumbbell on a base. A handle of the weights is removed before or after placement of the plurality of weights on the base. The weights each have a centrally positioned opening vertically extending therethrough and defining a receiving space. The receiving space of each weight is vertically aligned with the receiving space of each of the other weights. The handle is removably extended from the receiving space. The handle has a grip that is positioned below an uppermost one of the plurality of weights and above a lowermost one of the plurality of weights when the handle is positioned in the receiving space. A user determines a quantity of the weights to be used during an exercise to define a selected number. The selected number of the weights is engaged to a carriage after the handle has been removed from the plurality of weights. The selected number defines secured weights. The carriage is attached to a first end of a cable positioned on a pulley suspended from an upper end of a vertical support. The vertical support is attached to and extends upwardly from the base. Pulling a second end of the cable pulls the carriage and the secured weights upwardly toward the upper end. To perform an exercise, a handgrip is attached to the second end of the cable.

In another embodiment of the disclosure, the system includes an adjustable dumbbell assembly with a plurality of weights that is vertically stacked on top of each other. The weights each have a centrally positioned opening vertically extending therethrough and defining a receiving space. A handle is removably extendable into the receiving space. The handle has a grip that is positioned below an uppermost one of the plurality of weights and above a lowermost one of the plurality of weights when the handle is positioned in the receiving space. A coupler releasably engages a selected one of the weights to the handle and defines a coupled weight. The coupled weight and each of the weights positioned above the coupled weight are releasably secured to the handle. Each of the weights positioned below the coupled weight are disengaged from the handle. A pulley assembly for engaging the plurality of weights includes a base that has an upper surface. The plurality of weights is positionable on the upper surface and the plurality of weights is freely removable from the pulley assembly. A vertical support is attached to and extending upwardly from the base. A pulley is attached to the vertical support adjacent to an upper end of the vertical support. A cable positioned on the pulley has a first end and a second end. A carriage is attached to the first end of the cable and is releasably couplable to a selectable number of the weights when the handle is disengaged from the weights. The weights are releasably secured to the carriage and define secured weights. The secured weights are only restrained in movement by the carriage as the carriage moves upwardly from the base to a maximum lift location positioned adjacent to the upper end of the vertical support. A handgrip is attachable to the second end of the cable.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
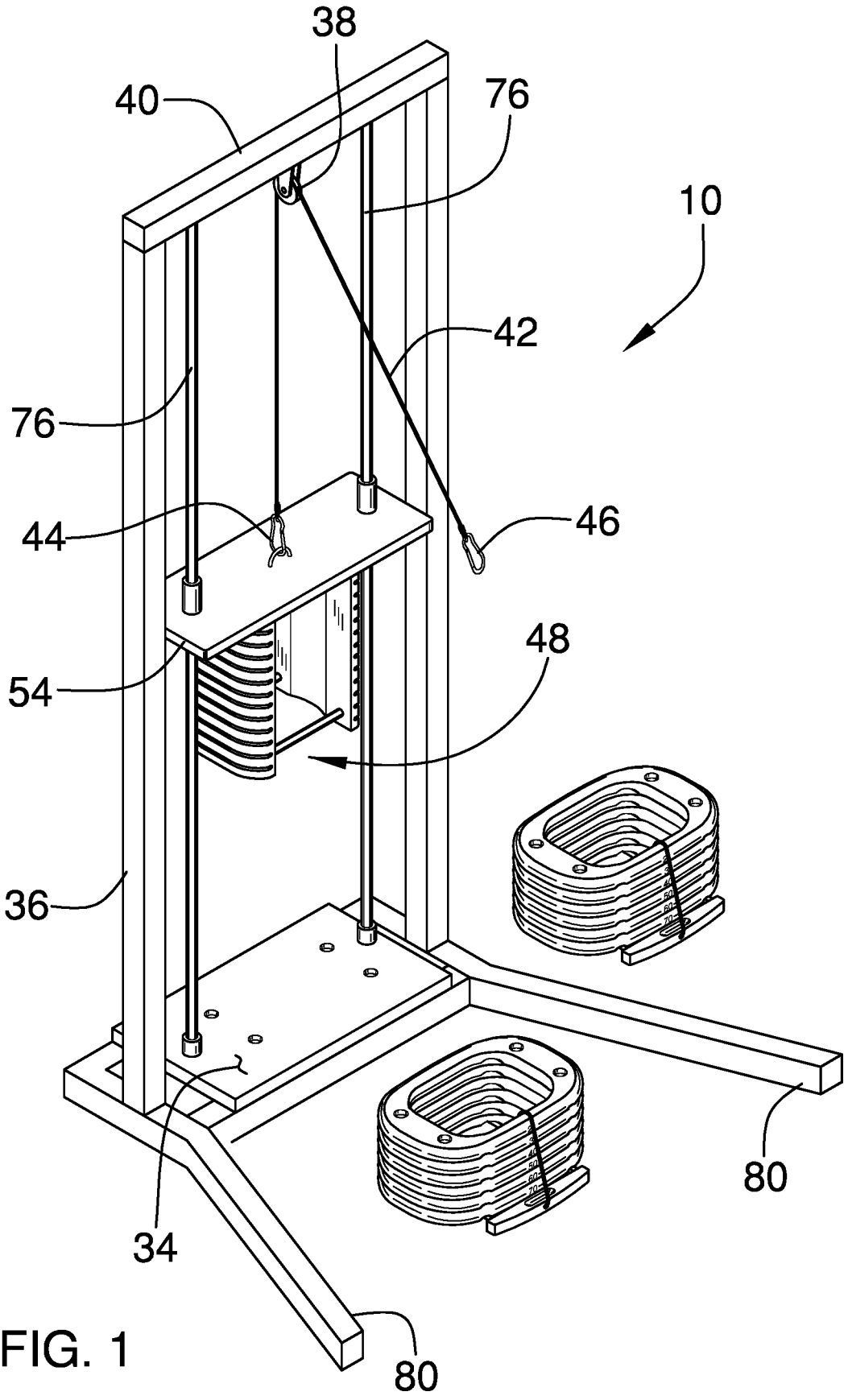
FIG. 1 is a front isometric view of a pulley weight exercise method and system according to an embodiment of the disclosure.
Figure 2:
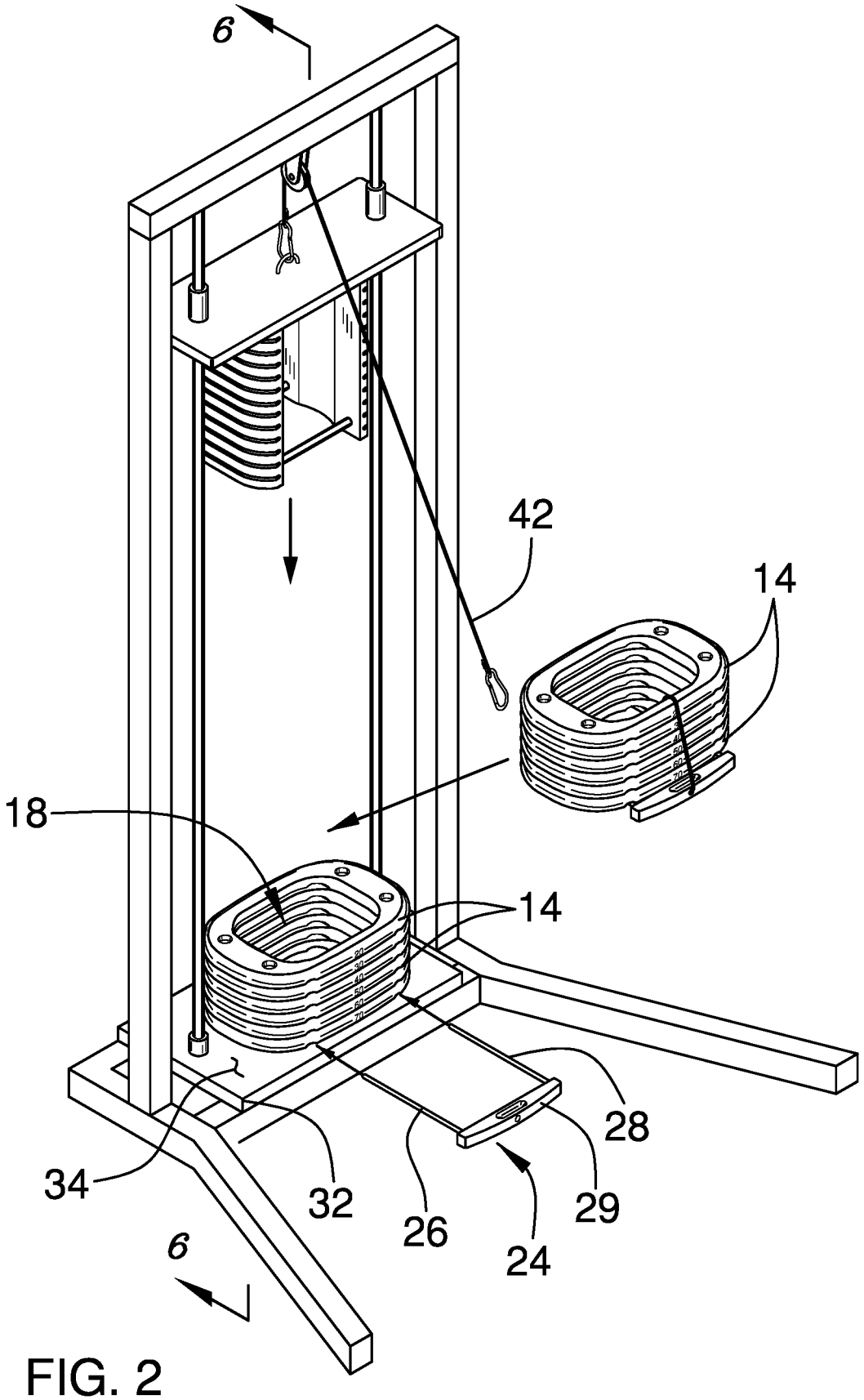
FIG. 2 is a front isometric view of an embodiment of the disclosure.
Figure 3:
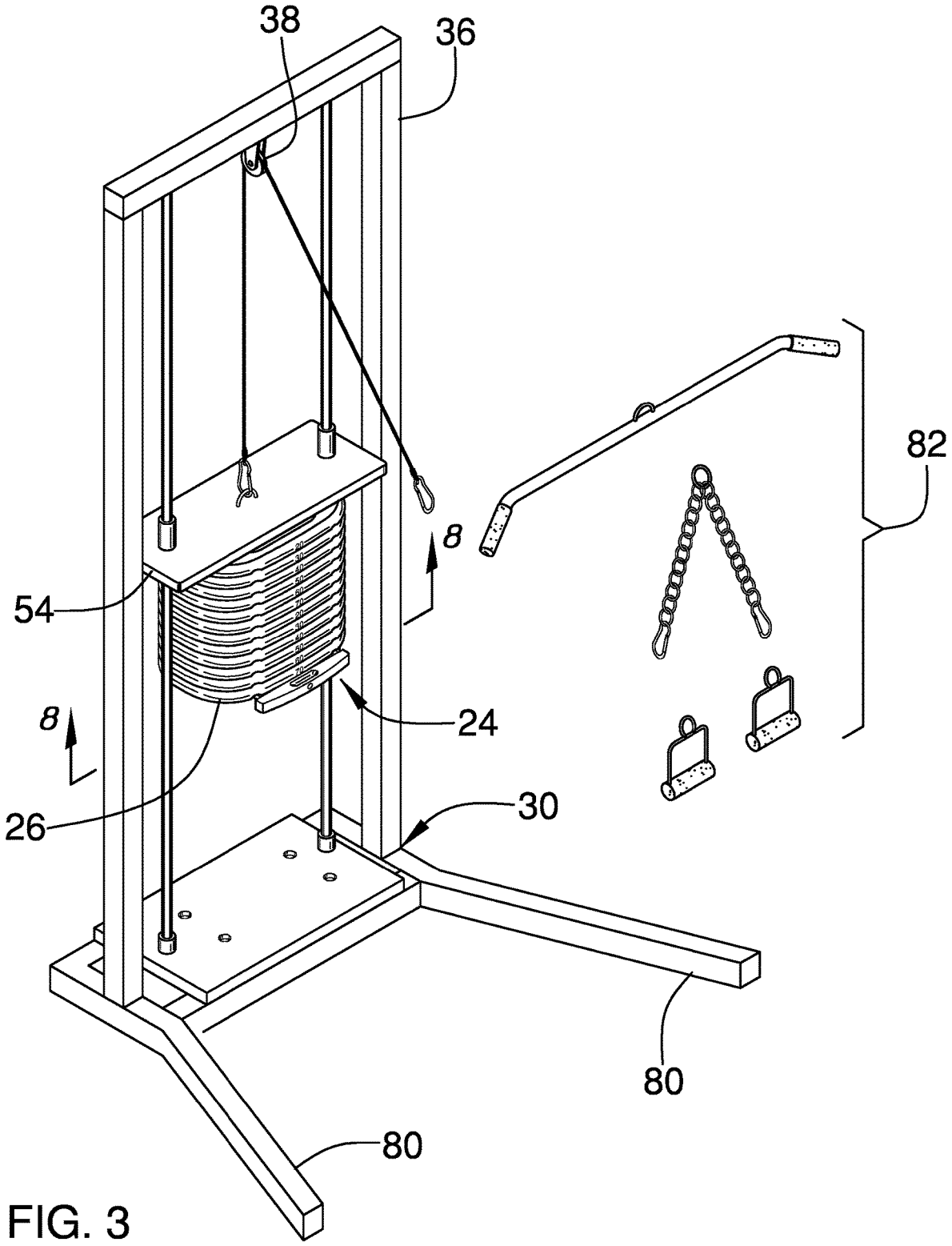
FIG. 3 is a front isometric view of an embodiment of the disclosure.

With reference now to the drawings, and in particular to FIGS. 1 through 13 thereof, a new pulley utilizing exercising device embodying the principles and concepts of an embodiment of the disclosure and generally designated by the reference numeral 10 will be described.

As best illustrated in FIGS. 1 through 13, the pulley weight exercise method and system 10 generally comprises a system 10 to be used with an adjustable dumbbell assembly 12 including a plurality of weights 14 wherein the weights 14 are vertically stacked on top of each other. Each of the weights 14 has a pair of outer edges 16 disposed oppositely from each other and defines a first lateral edge and a second lateral edge of the weights 14 in relation to additional elements of the adjustable dumbbell assembly 12. The weights 14 each have a centrally positioned opening vertically extending therethrough and that defines a receiving space 18. The receiving space 18 of each weight 14 is vertically aligned with the receiving space 12 of each of the other weights 14. Each of the weights 14 has a center of mass, wherein the center of mass of each weight 14 is positioned above the center of mass of a next adjacent weight 14 positioned therebelow such that center of masses of all the weights 14 are vertically spaced from each other. A handle 20 is removably extendable into the receiving space and the handle 20 includes grip 22. The grip 22 is positioned below an uppermost one of the plurality of weights 14 and above a lowermost one of the plurality of weights 14 when the handle 20 is positioned in the receiving space 12. A coupler 24 releasably engages a selected one of the weights 14 to the handle 20 and the weight 14 to which it is engaged defines a coupled weight 26. The coupled weight and each of the weights 14 positioned above the coupled weight 26 is releasably secured to the handle 20, and each of the weights 14 positioned below the coupled weight 26 are disengaged from the handle 20 such that only those weights 14 including and positioned above the coupled weight 26 are utilized during a weight lift exercise.

Figure 4:
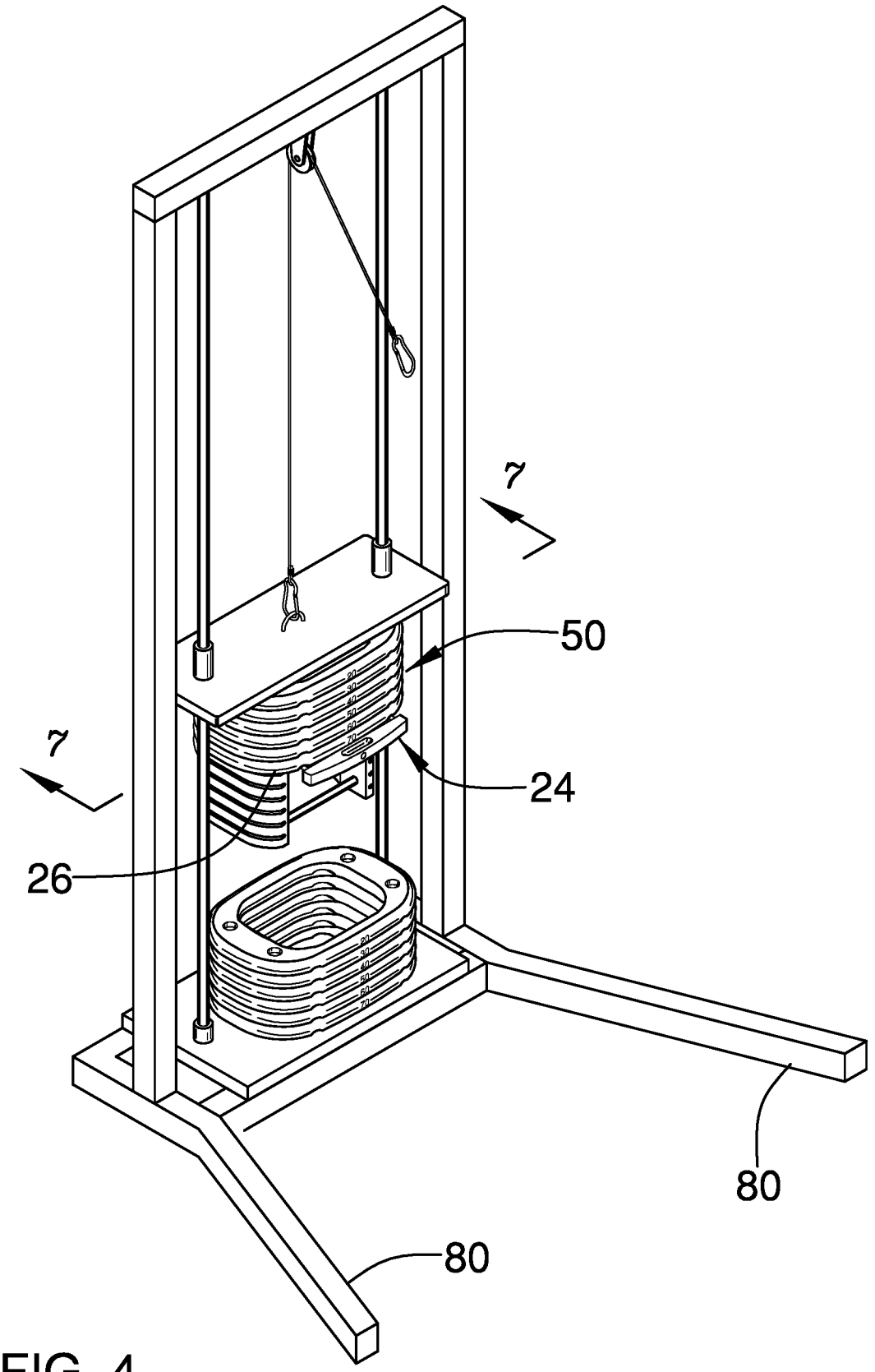
FIG. 4 is a front isometric view of an embodiment of the disclosure.
Figure 5:
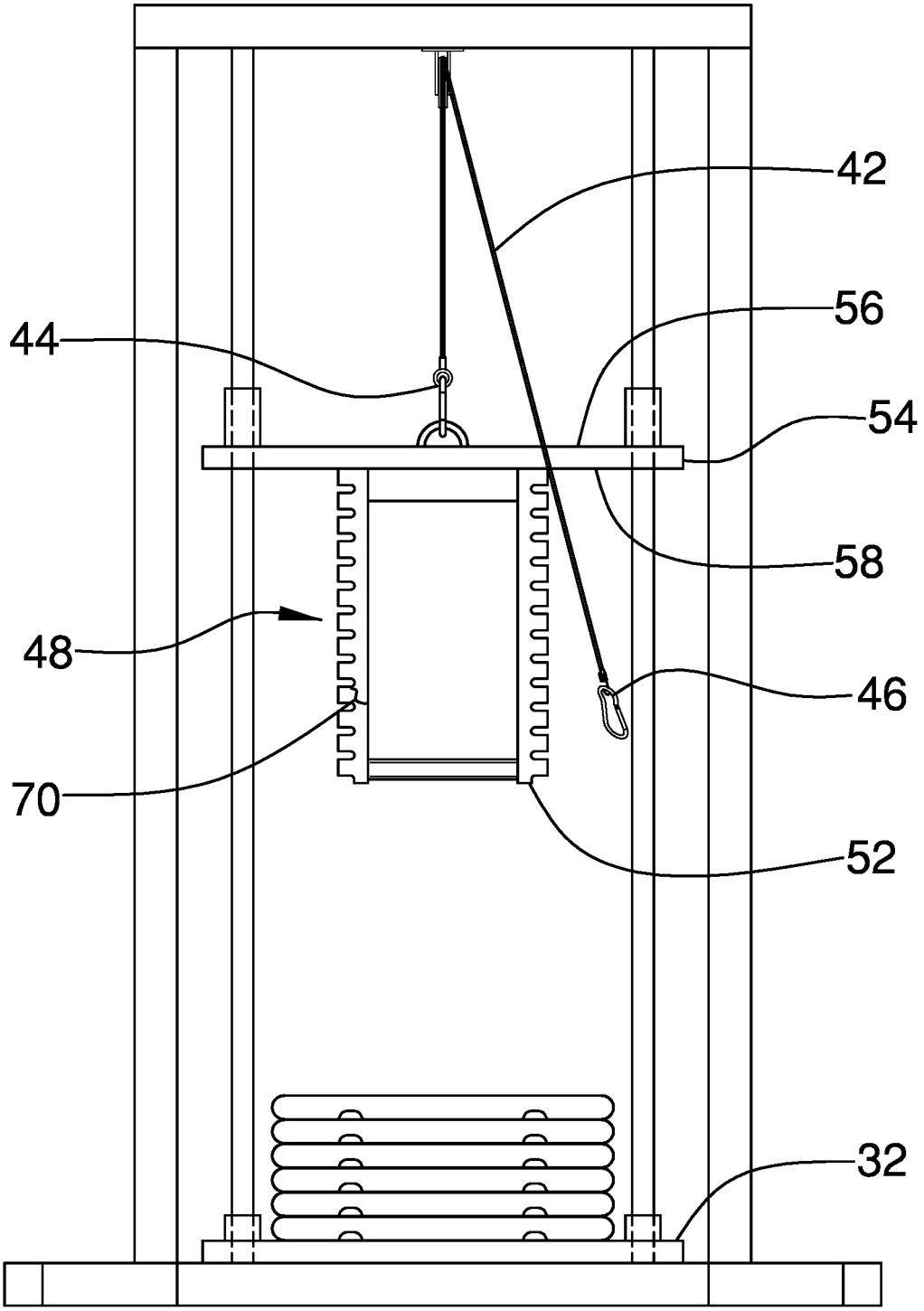
FIG. 5 is a front view of an embodiment of the disclosure.
Figure 6:
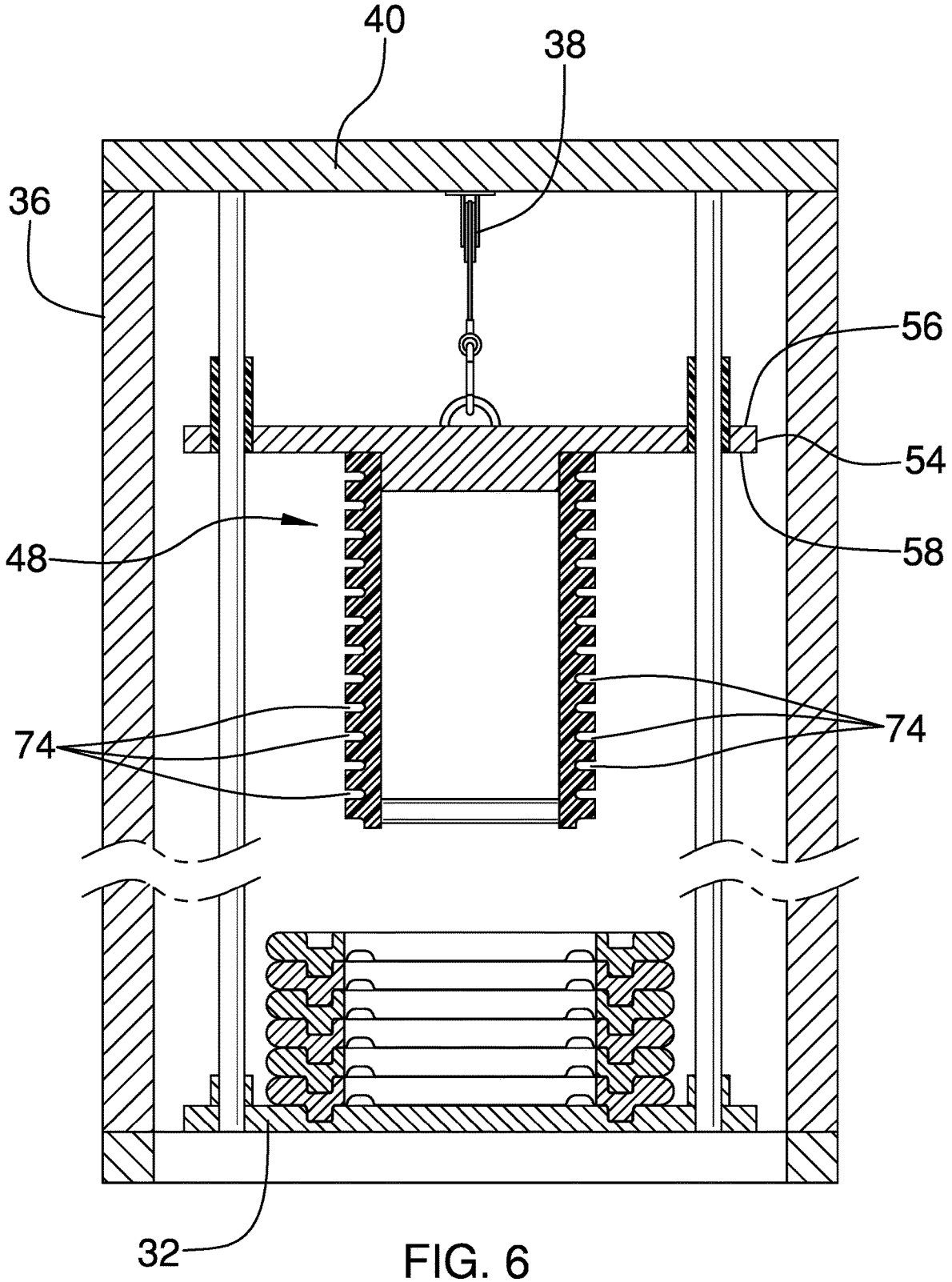
FIG. 6 is a cross-sectional view of an embodiment of the disclosure taken along line 6-6 of FIG. 2.
Figure 7:
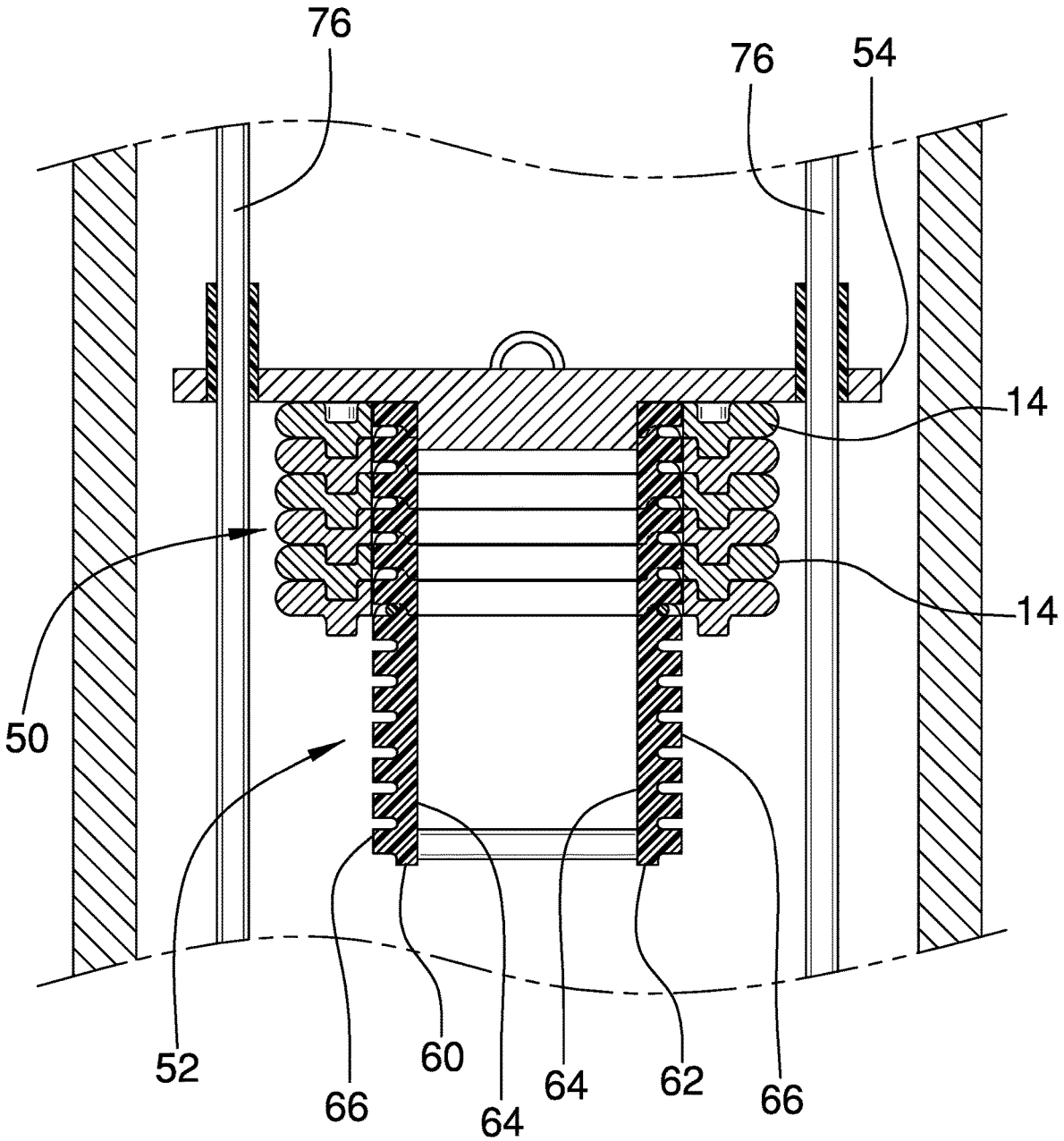
FIG. 7 is a cross-sectional view of an embodiment taken along line 7-7 of FIG. 4 of the disclosure.

The above types of dumbbells using adjustable weights are found in U.S. patent application Ser. No. 17/173,331, U.S. patent application Ser. No. 17/209,746, and U.S. patent application Ser. No. 17/512,752 each incorporated herein by reference. These types of dumbbells use weights 14 wherein the weights 14 are stacked upon each other in such a manner as to allow a user to determine, from the top weight to a bottom weight, the number of weights 14 required for a dumbbell utilizing exercise. Because the weights 14 of these types of dumbbells are stacked on top of each other, the system 10 may utilize multiple ones of the dumbbell assemblies 12 to selectively increase the effective maximum weight that is available while using the system 10. As shown in FIG. 4, for example, the weights 14 from a pair of dumbbell assemblies 12 are being utilized.

The system 10 additionally includes a pulley assembly 30 for engaging the plurality of weights 14 to allow for cable-type exercises utilizing the dumbbell assembly 12 weights 14 instead of conventional weight plates. The pulley assembly 30 includes a base 32 that has an upper surface 34. The plurality of weights 14 is positionable on the upper surface 34 are freely removable from the pulley assembly 30. The term "freely removable" is intended to mean that the pulley assembly 30 need not be fully or partially deconstructed to remove the weights 14 from the pulley assembly 30 so that the weights 14 can be added to, or removed from, the pulley assembly 30 by simply lifting the weighs 14 off of the base 32. The plurality of weights 14, when positioned on the base 32, will have the handle 20 removed from the plurality of weights 14. The handle 20 may be removed either before or after the weights 14 are placed on base 32, though typically the handle 20 will be used to move the weights 14 onto or off of the base 32.

The pulley assembly 30 further includes a vertical support 36 that is attached to and extends upwardly from the base 32. A pulley 38 is attached to the vertical support 36 adjacent to an upper end 40 of the vertical support 36. A cable 42 is provided which has a first end 44 and a second end 46, and the cable 42 is positioned on the pulley 38 such that the first end 44 is pulled upwardly when the second end 46 is pulled downwardly. The first 44 and/or second 46 ends may comprise conventional hooks, such as carabiner type hooks, used in weightlifting systems to facilitate efficient changing of various gripping members suited for different exercises. A carriage 48 is attached to the first end 44 of the cable 42 and is releasably couplable to a selectable number of the weights 14. The weights 14 are releasably secured to the carriage 48 to define secured weights 50. Generally, only the carriage 48 of the pulley assembly 30 restrains movement of the secured weights 50 as the carriage 48 moves upwardly from the base 32 to a maximum lift location positioned adjacent to the upper end 40 of the vertical support 36. That is, the weights 14 are otherwise not coupled to or encumbered by any other portion of the pulley system 30 whereas conventional pulley weight stacks utilize weights that are slidably coupled directly to a frame to prevent their movement in any direction outside of vertical movement.

The carriage 48 includes a mount 52 that is extendable into the receiving space 18. The coupler 24 may be releasably engageable with one of the weights 14 in a same manner that the coupler 24 engages the handle 20 to define the coupled weight 26. It should be understood that the pulley assembly 30 may include its own coupler 24 having a similar design as used with the dumbbell assembly 12 or it may be the same coupler 24 as used with the handle 20. Alternately, the coupler 24 used with the pulley system 30 may have a completely different design which is adopted for engaging the mount 52. However, the type of coupler 24 typically utilized will include one or more tines 28 or pins that are extendable between a pair of stacked ones of the weights 14 and inserted into the mount 52. A plate 54 is provided that has a top side 56 and a bottom side 58. The mount 52 is attached to and extends downwardly from the bottom side 58 while the first end 44 of the cable 42 is attached to the top side 56. The cable 42 may be directly attached to the top side 56 or the first end 44 may include a structure for releasably engaging a catch on the top side 56 of the plate 54. Embodiments that allow for releasable connection between the plate 54 and the cable 42 will also allow a user to place a conventional weight plate, such as a disc type weight having a central opening for receiving the end of a barbell, on the plate 54 and extend the cable through the central opening in the weight plate. However, the plate 54 may also include attachment points, such as hooks or catches, for engaging additional weights. The plate 54 is slidably attached to the vertical support 36 such that it can move vertically along the height of the vertical support 36 but is generally retained from lateral, forward, and rearward movement.

The mount 52 may have a structure which resembles, in some ways, the handle 20 as an efficient solution for coupling the weights 14 to the cable 42. Thus, the mount 52 may include a first lateral panel 60 and a second lateral panel 62. Each of the first 60 and second 62 lateral panels are vertically orientated and extend downwardly from the plate 58. Each of the first 60 and second 62 lateral panels has an inner surface 64, an outer surface 66 and a perimeter edge 68. The perimeter edge 68 includes a front edge 70 and a rear edge 72 positioned oppositely of each other. The front edges 70 each have a plurality of receivers 74 therein that are disposed in vertical alignment with each other and releasably engageable with the coupler 24. Each of the receivers 74 in one of the front edges 70 is horizontally aligned with one of the receivers 74 in the other one of the front edges 70 to define a pair of receivers 74. Each pair of receivers 74 is aligned with one of the weights 14. The receivers 74, as shown in the imagines, may be positioned in the outer surfaces 66 and extend through each of the front 70 and rear 72 edges. The coupler 24 may include a pair of tines 28 attached to a handhold 29. The tines 28 are engageable with the coupled weight 26 and an associated pair of the receivers 74. Alternatively, the mount 52 may have alternate shapes including a "plug" shape having a generally same shape as the receiving space 18 wherein the mount still includes either receivers 74 or wells for receiving the tines 28 of the coupler 24.

Figure 8:
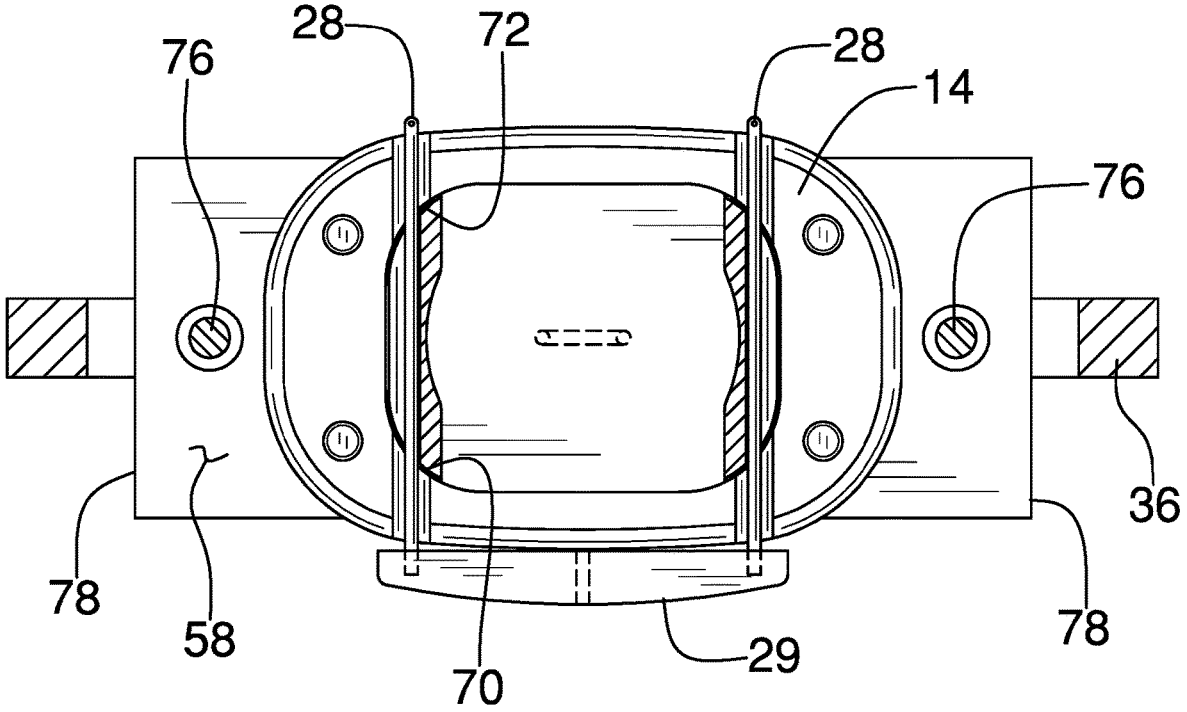
FIG. 8 is a cross-sectional view of an embodiment of the disclosure taken along line of FIG. 3.
Figure 9:
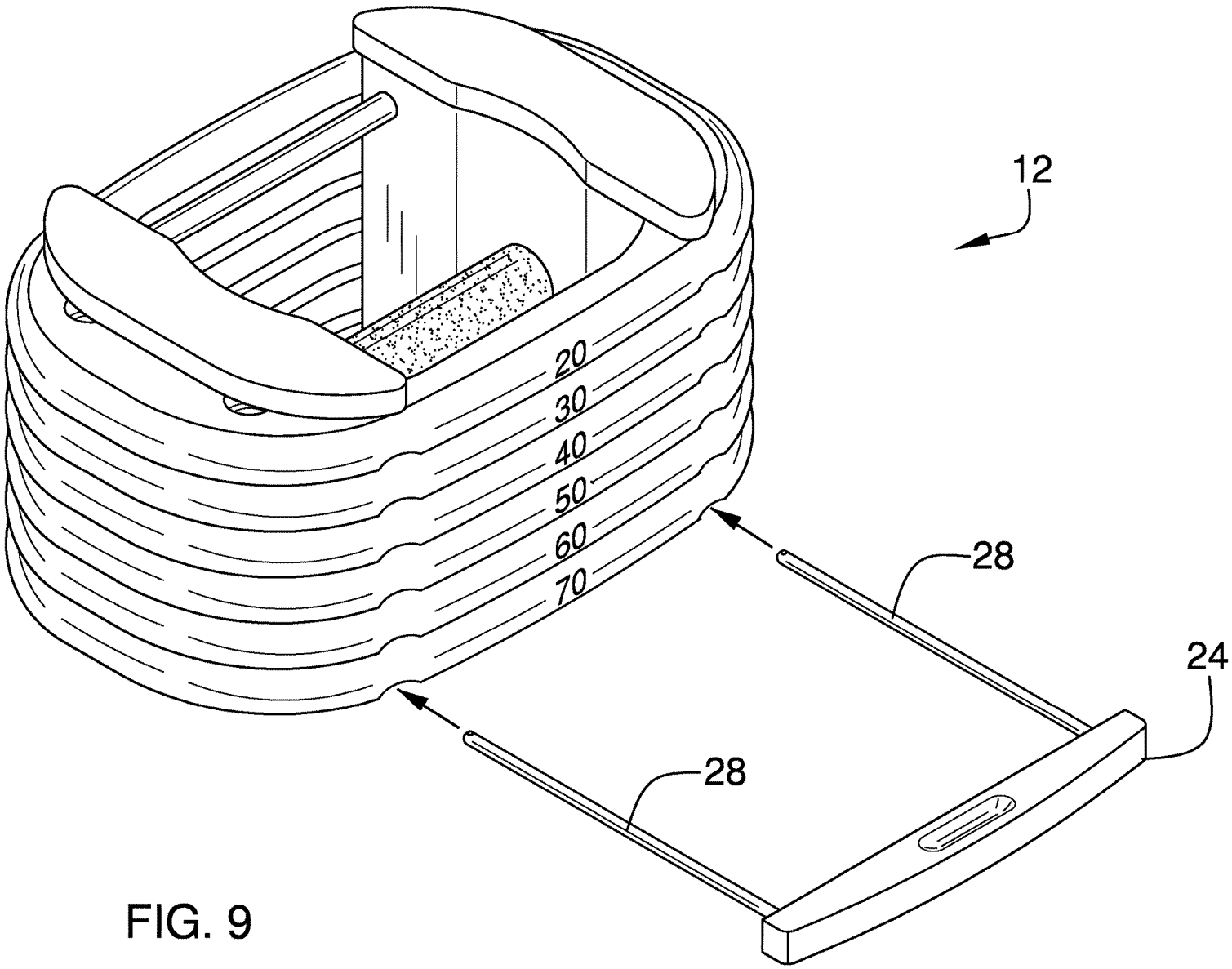
FIG. 9 is a front isometric view of a dumbbell assembly of an embodiment of the disclosure.
Figure 10:
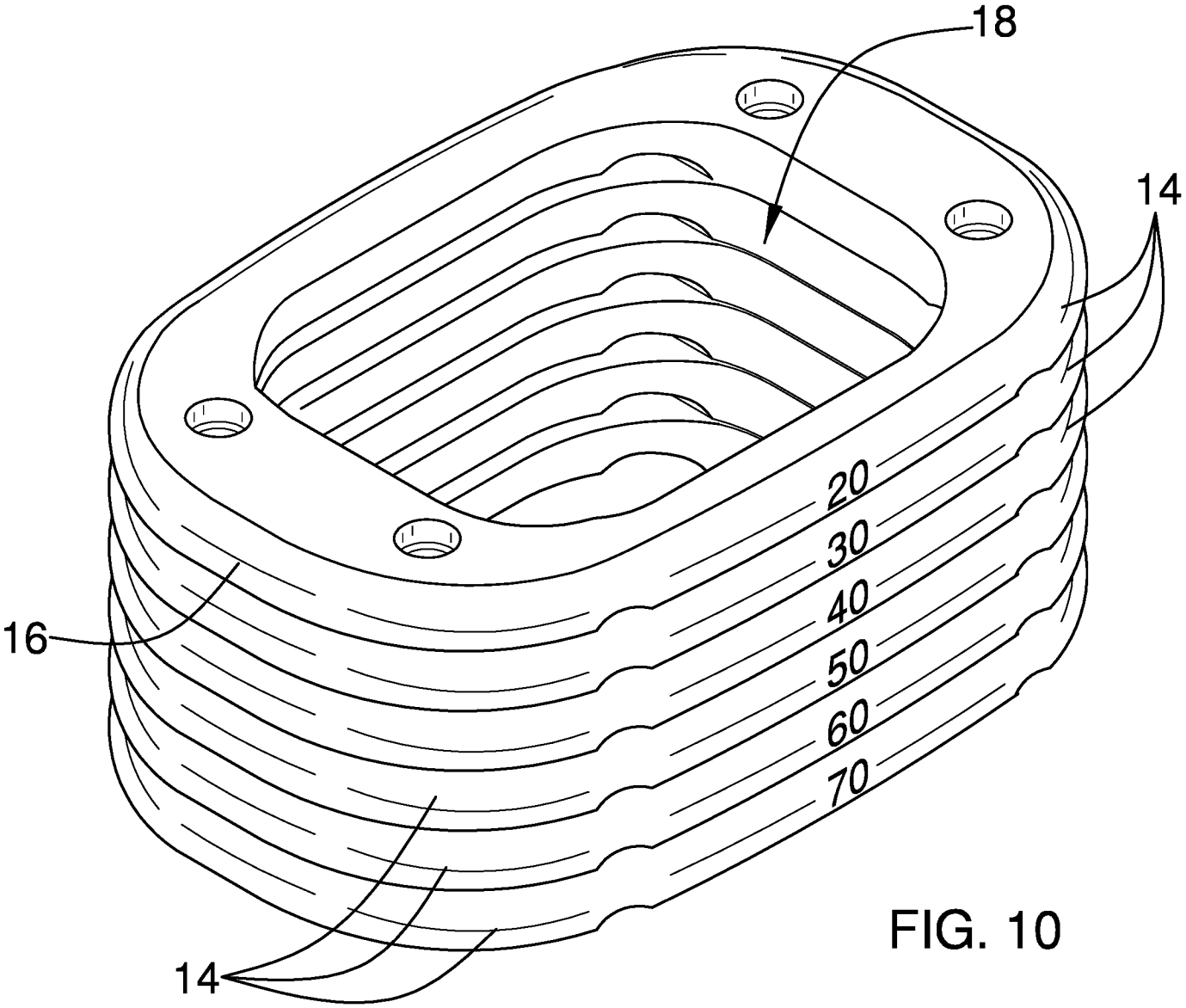
FIG. 10 is a front isometric view of a plurality of weights of an embodiment of the disclosure.
Figure 11:
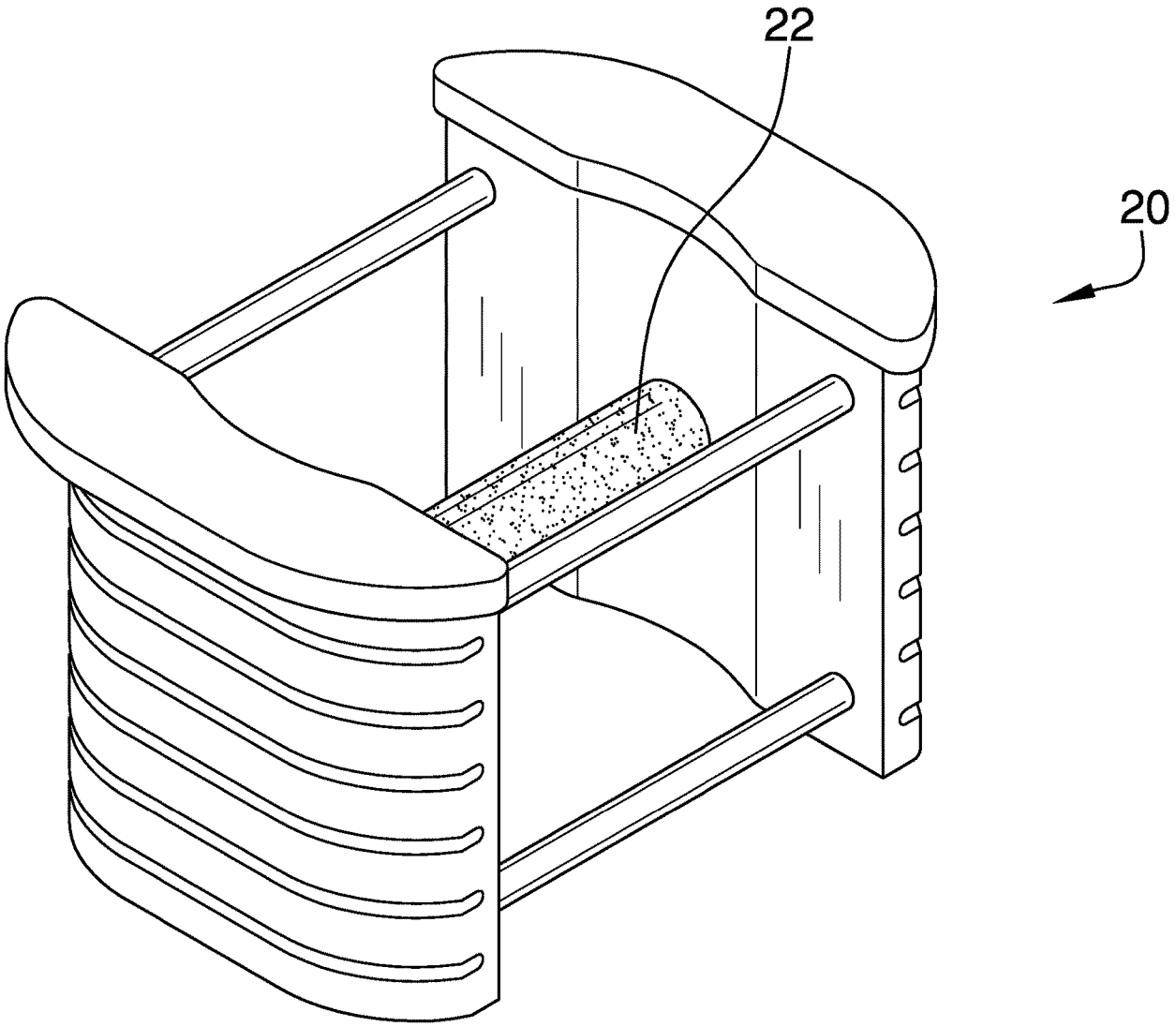
FIG. 11 is a front isometric view of a handle of an embodiment of the disclosure.
Figure 12:
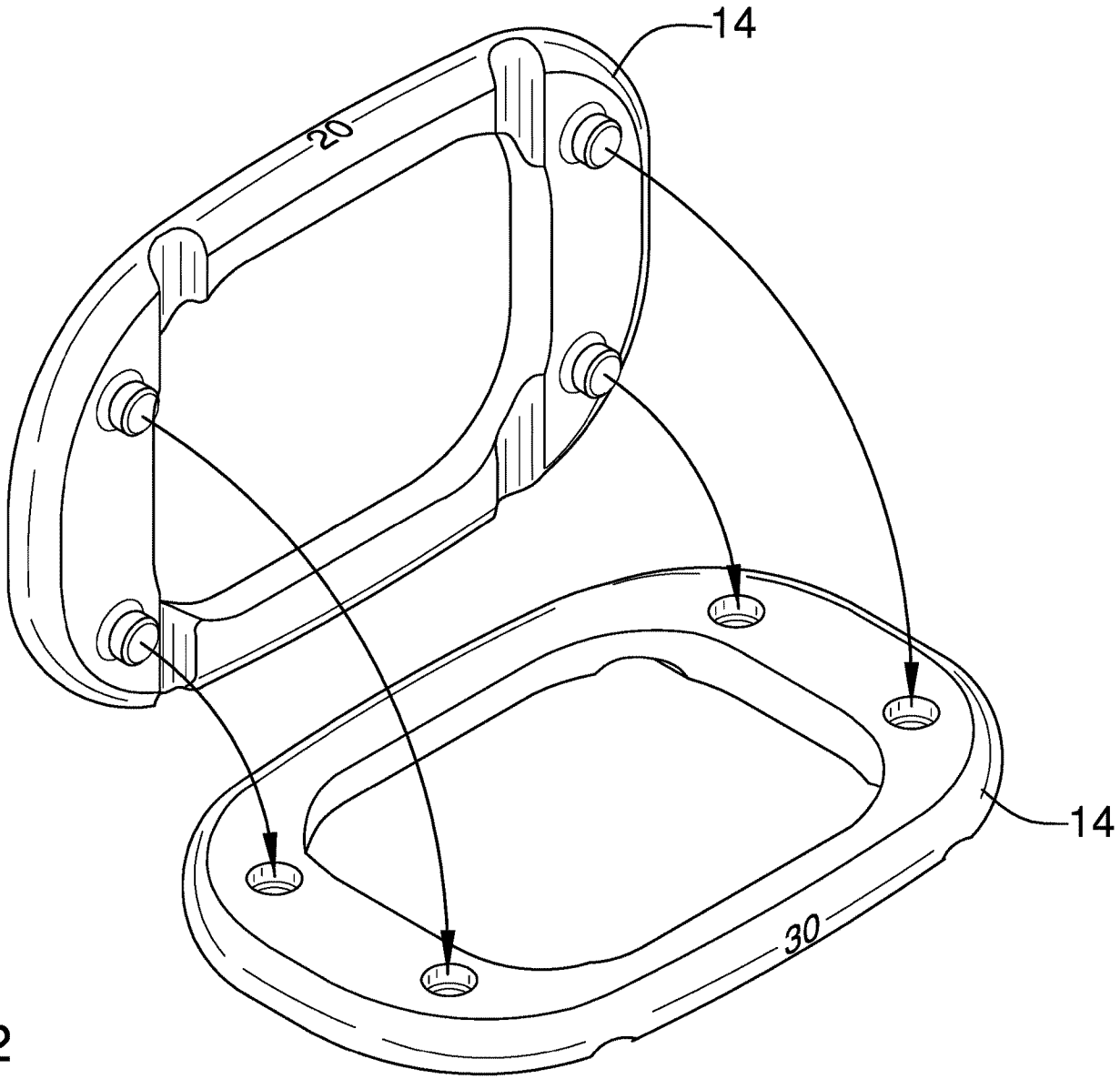
FIG. 12 is a front isometric view of the weights of an embodiment of the disclosure.
Figure 13:
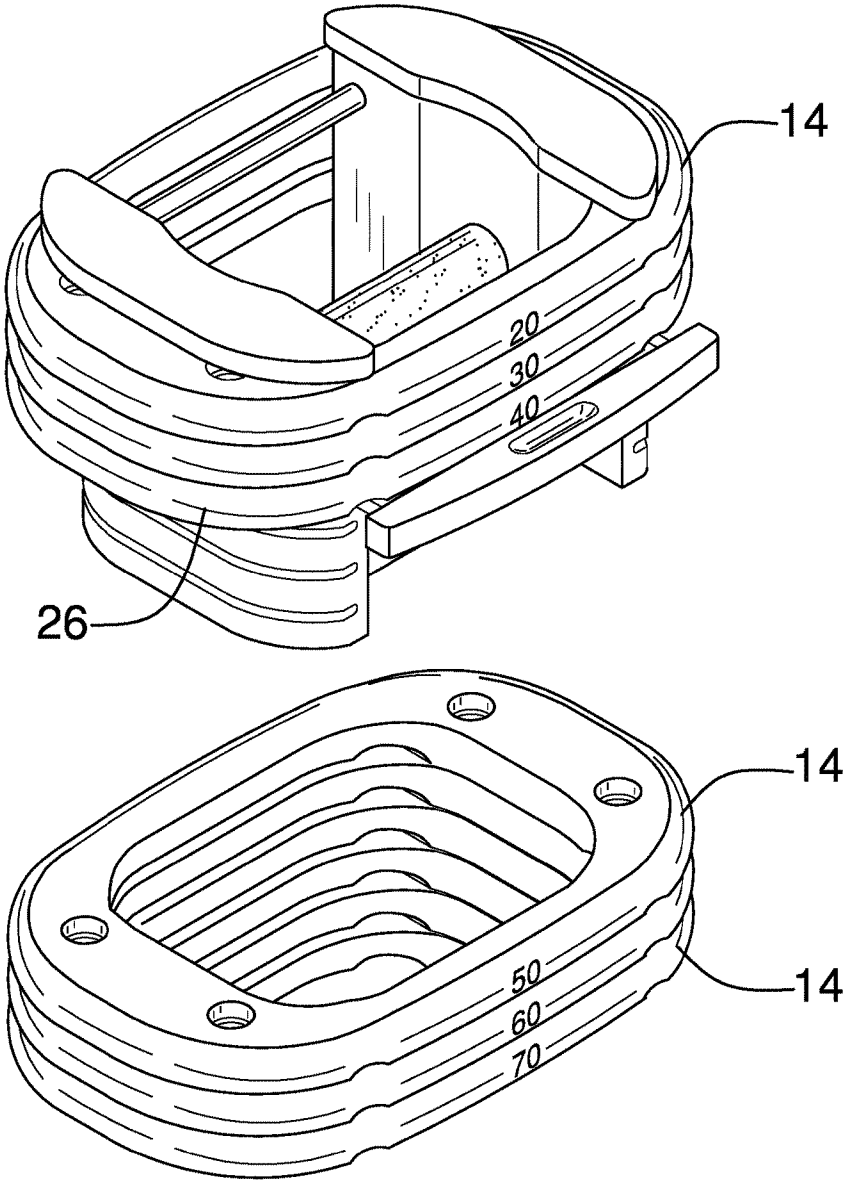
FIG. 13 is a front isometric view of the dumbbell assembly of an embodiment of the disclosure.

The vertical support 36 may include one or more, and if included most typically a pair, of rails 76 extending upwardly from the base 32. The rails 76 extend through the plate 54, and, though not needed, stabilize the plate 54 relative to the vertical support 36. As shown in FIG. 8, the plate 54 has a pair of lateral edges 78 and each of the rails 76 is positioned adjacent to one of the lateral edges 78. The weights 14 are positioned between the rails 76 but do not engage the rails 76 and most often are laterally spaced from the rails 76. The base 32 and vertical support 36 may include stabilizing members 80 extending outwardly for engaging a floor surface to ensure that the pulley assembly 30 remains in a stable, vertical orientation. It should be understood that the pulley assembly 30 may include multiple pulley assemblies 30 coupled together and each may take different shapes and be of differing heights to provide for a variety of exercises typically accomplished with conventional pulley based exercising machines.

A handgrip 82 is attachable to the second end 46 of the cable 42. The handgrip 82 may be tailored for specific exercises and many different, conventional handgrips are utilized with pulley exercising machines. For example, elongated bars may be used for doing what are known as "lat pull-downs" (for exercising the latissimus dorsi) while the same bar, or a shorter version thereof, can be used for various triceps exercises. Smaller handgrips 82 including single handholds may be used for exercising a single arm while rope-based handgrips target smaller muscle groups as well as allowing a user's wrists to rotate through an exercise. Generally, all conventional handgrips 82 used with pulley systems may be coupled to the second end. It should be further understood that, though not shown, a movable pulley may be added for engagement of the cable 42 between the pulley 38 attached to the upper end 40 and the base 32. The movable pulley will be attached to the vertical support 36 and be movable along the height of the vertical support 36 to adjust the angle at which the cable 42 engages a user. This will facilitate, for example, biceps exercises where the second end 46 is lifted upwardly and is a conventional feature of many pulley-based systems.

Alternatively, the pulley assembly 30 may be mechanically coupled to other lifting machines, such as those used for leg exercises, for instance which often use pulley and weight combination systems for resistance. For such configurations the lifting machines are attached to the second end 46 of the cable 42 instead of the handgrip 82.

In use, the pulley assembly 30 will allow a person to use a single weight set of dumbbell assemblies 12 to serve not only as the basis for dumbbell specific exercises, but also for a pulley-based system. It should be understood, that the system 10 may allow for the use the weight sets from multiple ones of the dumbbell assemblies 12 and the mount 52 of the carriage 48 will typically have a size to accept the weights 14 form at least a pair of dumbbell assemblies 12, though the mount 52 may be increased in size to accept more weights 12 if such is determined to be practical and advantageous. Exercises utilizing cables 42 can target muscle groups not easily exercised with dumbbells alone while offering a fluid resistance to decrease the chances of injury. Moreover, since the weights 14 themselves are often a considerable contributor to the overall cost of a workout system, there is a corresponding significant reduction in overall cost by having the ability to use the weights 14 with more than one type of exercise equipment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cable lifting system including:

an adjustable dumbbell assembly including:

a plurality of weights being vertically stacked on top of each other, the weights each having a centrally positioned opening vertically extending therethrough and defining a receiving space;

a handle being removably extendable into the receiving space, the handle having a grip, the grip being positioned below an uppermost one of the plurality of weights and above a lowermost one of the plurality of weights when the handle is positioned in the receiving space; and a coupler releasably engaging a selected one of the weights to the handle and defining a coupled weight, wherein the coupled weight and each of the weights positioned above the coupled weight being releasably secured to the handle, wherein each of the weights positioned below the coupled weight are disengaged from the handle;

a pulley assembly for engaging the plurality of weights, the pulley assembly including:

a base having an upper surface, the plurality of weights being positionable on the upper surface, the plurality of weights being freely removable from the pulley assembly;

a vertical support being attached to and extending upwardly from the base;

a pulley being attached to the vertical support adjacent to an upper end of the vertical support;

a cable having a first end and a second end, the cable being positioned on the pulley; and a carriage being attached to the first end of the cable, the carriage being releasably couplable to a selectable number of the weights when the handle is disengaged from the weights, the weights being releasably secured to the carriage and defining secured weights, wherein only the carriage of the pulley assembly restrains movement of the secured weights as the carriage moves upwardly from the base to a maximum lift location positioned adjacent to the upper end of the vertical support; and a handgrip being attachable to the second end of the cable.

2. The cable lifting system according to claim 1, wherein the carriage includes:

a mount being extendable into the receiving space;

the coupler being releasably engageable with one of the weights in a same manner that the coupler engages the handle to define the coupled weight; and a plate having a top side and a bottom side, the mount being attached to and extending downwardly from the bottom side, the plate being slidably attached to the vertical support.

3. The cable lifting system according to claim 2, wherein: the mount includes:

a first lateral panel and a second lateral panel, each of the first and second lateral panels being vertically orientated and extending downwardly from the plate, each of the first and second lateral panels having an inner surface, an outer surface and a perimeter edge, wherein the perimeter edge includes a front edge and a rear edge positioned oppositely of each other;

the front edges each having a plurality of receivers therein being disposed in vertical alignment with each other and releasably engageable with the coupler, each of the receivers in one of the front edges being horizontally aligned with one of the receivers in the other one of the front edges to define a pair of receivers, each pair of receivers being aligned with one of the weights;

the coupler including a pair of tines attached to a handhold, the tines being engageable with the coupled weight and an associated pair of the receivers.

4. The cable lifting system according to claim 3, wherein the vertical support includes a pair of rails extending upwardly from the base, the rails extending through the plate, the plate having a pair of lateral edges, each of the rails being positioned adjacent to one of the lateral edges, the weights being positioned between the rails.

5. The cable lifting system according to claim 2, wherein the vertical support includes a pair of rails extending upwardly from the base, the rails extending through the plate, the plate having a pair of lateral edges, each of the rails being positioned adjacent to one of the lateral edges, the weights being positioned between the rails.

6. A method of using an adjustable dumbbell with a cable lifting system, the method including the steps of:

placing a plurality of weights from an adjustable dumbbell on a base, a handle of the weights being removed before or after placement of the plurality of weights on the base, the weights each having a centrally positioned opening vertically extending therethrough and defining a receiving space, the receiving space of each weight being vertically aligned with the receiving space of each of the other weights, the handle being removably extended from the receiving space, the handle having a grip, the grip being positioned below an uppermost one of the plurality of weights and above a lowermost one of the plurality of weights when the handle is positioned in the receiving space; and determining a quantity of the weights to be used during an exercise, the quantity of weights defining a selected number;

engaging the selected number of the weights to a carriage after the handle has been removed from the plurality of weights, the selected number defining secured weights, the carriage being attached to a first end of a cable positioned on a pulley suspended from an upper end of a vertical support, the vertical support being attached to and extending upwardly from the base, whereupon pulling a second end of the cable pulls the carriage and the secured weights upwardly toward the upper end; and attaching a handgrip to the second end of the cable.

7. The method of claim 6, wherein the step of engaging the selected number of weights further includes only the carriage of the pulley assembly restraining movement of the secured weights as the carriage moves upwardly from the base to a maximum lift location positioned adjacent to the upper end of the vertical support.

8. The method of claim 6, wherein the step of engaging the selected number of weights further include the steps of:

extending a mount of the carriage into the receiving space;

releasably engaging a coupler with the mount and one of the weights wherein the weight engaged with the coupler defines a coupled weight, each of the weights positioned above the coupled weight being engaged with the mount and each of the weights below the coupled weight being disengaged with the mount.

9. The method of claim 8, wherein the step of engaging the selected number of weights further includes the mount being attached to and extending downwardly from a plate, the plate being attached to and vertically slidable with respect to the vertical support.

10. The method of claim 8, wherein the step of engaging the selected number of weights further includes engaging one of a plurality of pairs of receivers in the mount with the coupler, the mount including a first lateral panel and a second lateral panel, each of the first and second lateral panels being vertically orientated and extending downwardly from the plate, each of the first and second lateral panels having an inner surface, an outer surface and a perimeter edge, wherein the perimeter edge includes a front edge and a rear edge positioned oppositely of each other, the front edges each having a plurality of the receivers therein being disposed in vertical alignment with each other and releasably engageable with the coupler, each of the receivers in one of the front edges being horizontally aligned with one of the receivers in the other one of the front edges to define the pair of receivers, each pair of receivers being aligned with one of the weights.

11. The method of claim 10, wherein the step of engaging the selected number of weights further includes extending tines of the coupler into the pair of receivers, the tines being attached to a handhold.

* * * * *